United States Patent [19]

Seilly et al.

[11] 4,282,843

[45] Aug. 11, 1981

[54] LIQUID FUEL INJECTION PUMP

[75] Inventors: Alec H. Seilly, North Wembley; Dorian F. Mowbray, Burnham, both of England

[73] Assignee: Lucas Industries Limited, Birmingham, England

[21] Appl. No.: 20,621

[22] Filed: Mar. 15, 1979

[30] Foreign Application Priority Data

Mar. 22, 1978 [GB] United Kingdom ..... 11313/78

[51] Int. Cl.[3] ..... F04B 3/00; F02D 1/00

[52] U.S. Cl. ..... 123/450; 123/504; 123/467; 417/253; 417/462

[58] Field of Search ..... 123/139 AM, 140 FP, 123/140 FG, 139 E, 139 AL, 450, 504, 467; 417/253, 462

[56] References Cited

U.S. PATENT DOCUMENTS

| | | | |
|---|---|---|---|
| 3,035,523 | 5/1962 | Kemp | 123/139 AM |
| 3,107,661 | 10/1963 | Kemp | 123/139 AM |
| 3,745,420 | 7/1973 | Hafner | 361/203 |
| 3,930,484 | 1/1976 | Skinner | 123/139 AM |
| 3,936,232 | 2/1976 | Mowbray | 417/253 |
| 3,961,861 | 6/1976 | Mowbray | 417/253 |
| 4,002,415 | 1/1977 | Nicholls | 417/462 |
| 4,014,305 | 3/1977 | Skinner | 123/139 AM |
| 4,091,784 | 5/1978 | Seilly | 123/139 E |
| 4,092,965 | 6/1978 | Lintott | 123/140 FG |
| 4,116,186 | 9/1978 | Drori | 123/139 AM |

FOREIGN PATENT DOCUMENTS

| | | | |
|---|---|---|---|
| 652282 | 11/1962 | Canada | 123/139 AM |
| 1178643 | 9/1964 | Fed. Rep. of Germany | 123/139 AM |
| 868625 | 5/1961 | United Kingdom | 123/139 AM |

*Primary Examiner*—Charles J. Myhre
*Assistant Examiner*—Carl Stuart Miller

[57] ABSTRACT

A fuel pumping apparatus includes an injection pump to which fuel is supplied by a low pressure supply pump. A shuttle located in a cylinder has one end connected to the injection pump and the other end to the supply pump when it is desired to feed fuel to the engine. The movement of the shuttle represents the amount of fuel supplied to the injection pump and this movement is measured and the signal supplied to a processing circuit which also receives a demand signal. The movement of the shuttle is halted by the gradual closure of communication between the one end of the cylinder and the injection pump. This is achieved in the example by a passage moving out of registration with a port. The rate of flow of fuel from the pump to the cylinder is controlled by a fuel control device the setting of which is determined by the processing circuit which strives to ensure that the actual amount of fuel supplied to the injection pump is equal to the desired amount.

18 Claims, 13 Drawing Figures

LIQUID FUEL INJECTION PUMP

Figure 1:
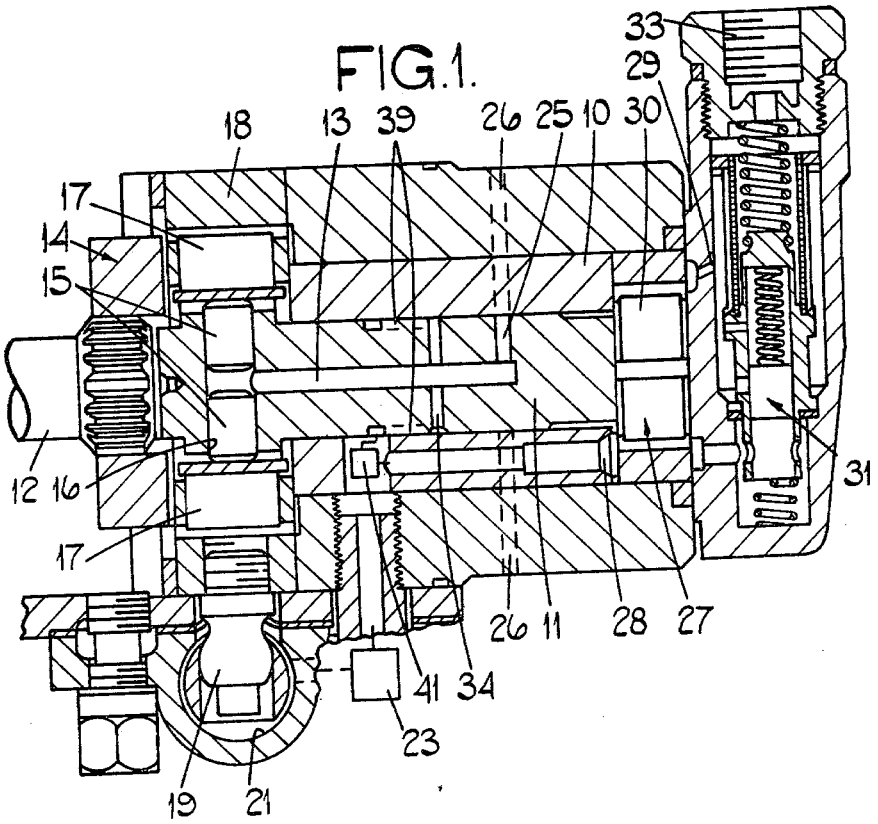

This invention relates to liquid fuel injection pumping apparatus for supplying fuel to an internal combustion engine and of the kind comprising a housing, a rotary distributor member mounted within the housing and which in use is driven in timed relationship with the associated engine, an injection pump also driven in use, in timed relationship with the engine, the injection pump including a pump chamber, the apparatus further including a delivery passage formed in the distributor member and communicating with the pump chamber, an outlet port formed in the housing and with which the delivery passage registers during an injection stroke of the injection pump, a feed port formed in the housing and a feed passage in the distributor member communicating with the pump chamber, said feed port and feed passage being brought into registration in the interval between injection strokes of the injection pump, a feed pump for supplying liquid fuel at a low pressure, and means for varying the amount of fuel supplied to the injection pump from the feed pump.

Such apparatus is well known in the art and in its simplest form the means for varying the amount of fuel supplied to the injection pump comprises an adjustable throttle the setting of which can be varied by an engine operator usually in conjunction with a governor which controls at least the maximum speed of the engine to which fuel is supplied by the apparatus. For the sake of controlling exhaust emission and for limiting the torque which can be developed by the engine, it has been the practice to employ some form of maximum fuel determining device so that irrespective of the setting of the throttle and the speed of the associated engine, the maximum amount of fuel which can be supplied by the apparatus at each injection stroke of the injection pump is fixed.

One form of such a device is stop means in the injection pump which limits the amount of fuel which can be supplied to the injection pump and thereby the amount of fuel which can be supplied by the apparatus. This type of device while simple in form has the disadvantage that it cannot be readily adjusted whilst the apparatus is in use. Such adjustment is desirable while the apparatus is in use to provide for example, for control of the maximum power output of the engine in accordance with engine speed and for the provision of excess fuel for starting etc. Moreover, the use of a throttle i.e. a variable restrictor, to control the amount of fuel supplied to the injection pump is not a very reliable method by itself, of effecting such control since its performance depends on a number of factors, e.g. the output pressure of the feed pump and the viscosity of the fuel both of which can vary while the apparatus is in use.

One way of overcoming the disadvantage of the stop means in the injection pump is to provide a reciprocable shuttle in the housing. The maximum excursion of the shuttle determines at least the maximum amount of fuel which can be supplied to the injection pump. The shuttle movement can be determined by an adjustable stop or stops at the ends of the cylinder in which it is located. A throttle can be used to control the amount of fuel which is supplied when less than the maximum amount of fuel is being supplied by the injection pump. Alternatively, the stop or stops themselves can be adjusted by the operator of the engine so that the shuttle determines the amount of fuel supplied by the apparatus throughout the range of engine operation.

Experience has shown that the use of a shuttle in conjunction with a stop introduces the problem of cavitation. It is found that when the shuttle strikes the stop at one end of its cylinder when fuel is being supplied from said one end of the cylinder to the injection pump, a cavity can be formed in the fuel column between said one end of the cylinder and the injection pump. The fact that a cavity is formed upsets the volume of fuel supplied to the injection pump and the collapse of the cavity can cause serious erosion of the machines parts of the apparatus. Moreover, in the case where the throttle determines the quantity of fuel supplied to the engine when less than the maximum quantity is being supplied, the problem related above still applies.

The object of the present invention is to provide an apparatus of the kind specified in a simple and convenient form.

According to the invention an apparatus of the kind specified comprises a shuttle movable in a cylinder, control means for controlling the flow of fuel to one end of said cylinder while the other end of said cylinder is in communication with said feed port, the rate of movement of said shuttle towards said one end of the cylinder being reduced as the feed passage moves out of register with the feed port and the movement of the shuttle ceasing as the feed port and feed passage move out of register, measuring means for measuring the displacement of the shuttle which takes place while fuel is flowing from said one end of the cylinder and signal processing means responsive to the signal produced by the said measuring means for adjusting said control means in the event that the quantity of fuel supplied to the injection pump differs from the desired quantity of fuel.

The apparatus outlined above seeks to overcome the problems encountered with the use of a shuttle, by using the shuttle movement only to provide an indication of the amount of fuel which is supplied to the injection pump. No form of stop is provided to limit the movement of the shuttle whilst fuel is being supplied to the injection pump and therefore the problem of cavitation as outlined above is overcome. Moreover, if the control means does have the form of an adjustable throttle the difficulties outlined above with a throttle are overcome by adjusting the throttle during the operation of the apparatus so that the quantity of fuel which is supplied to the injection pump is maintained so far as is possible, at the desired quantity.

Figure 2:
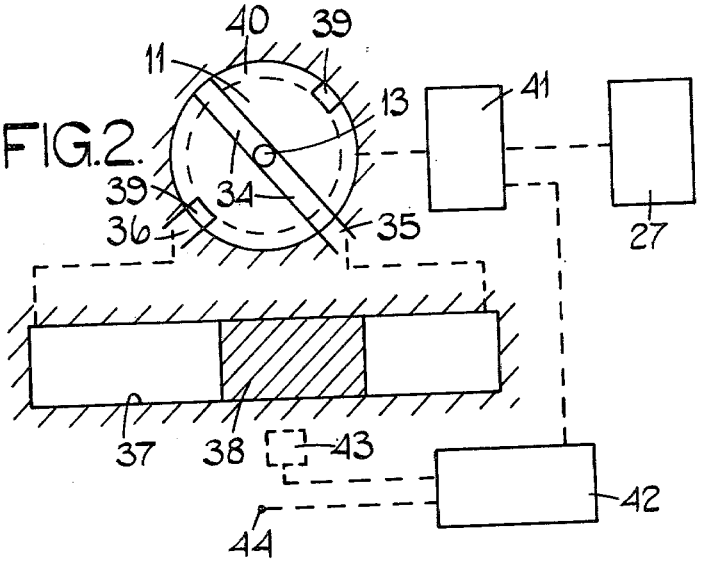
Figure 3:
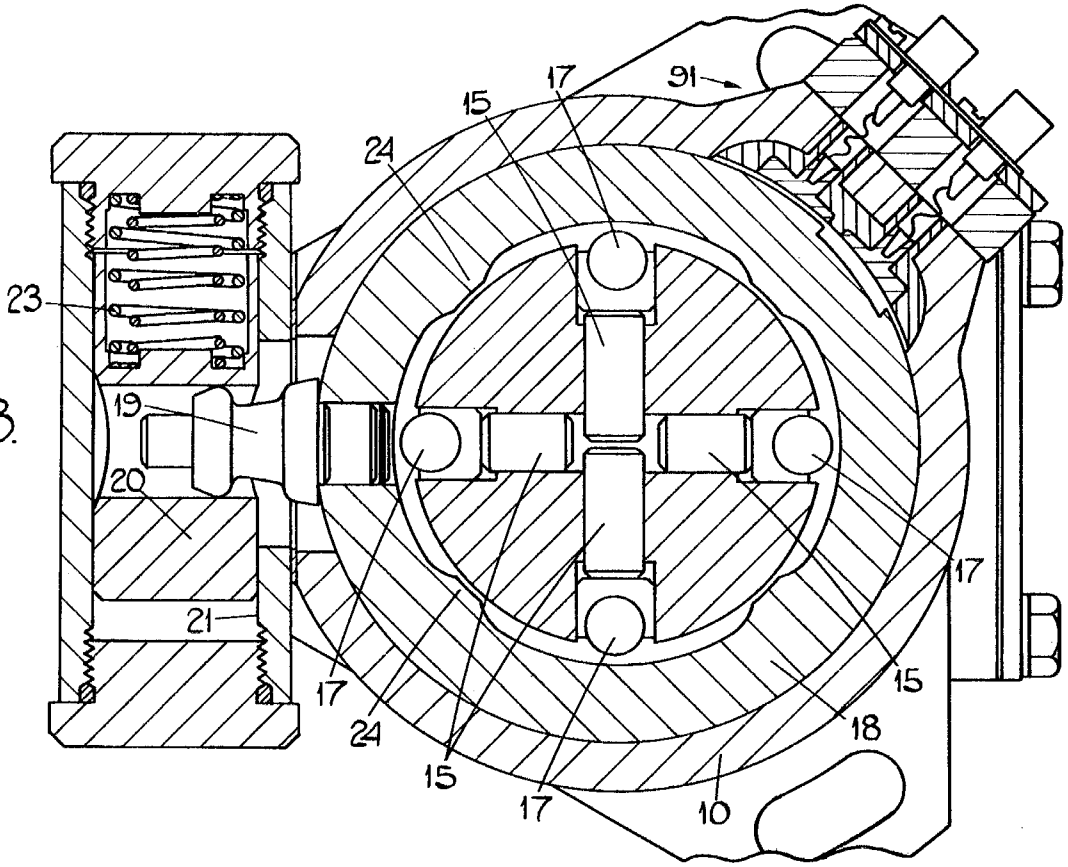
Figure 4:
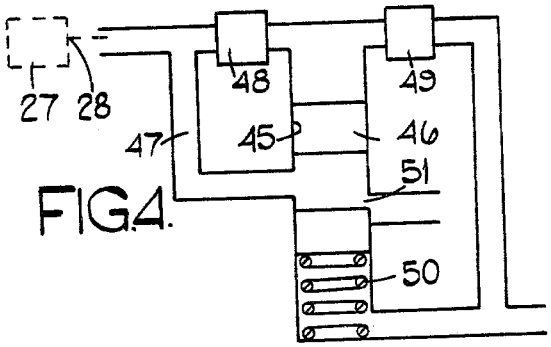
Figure 5:
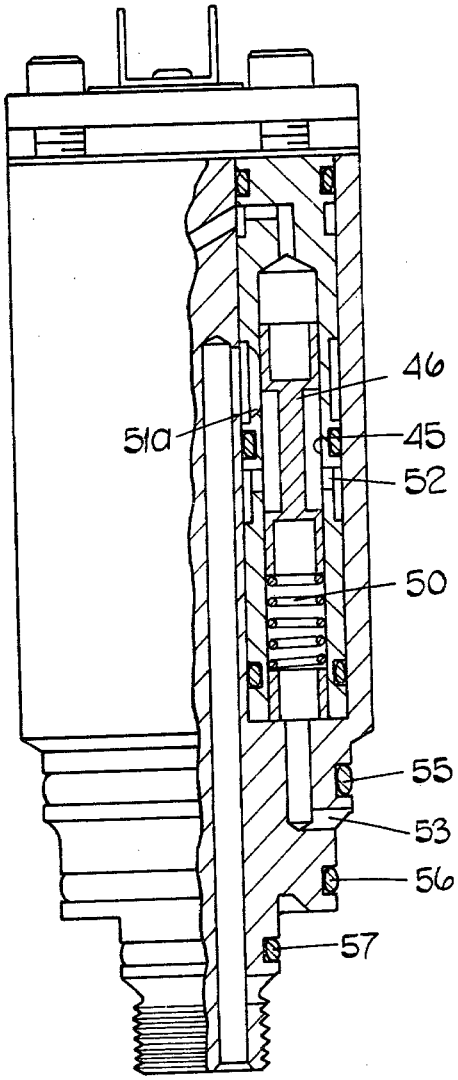
Figure 6:
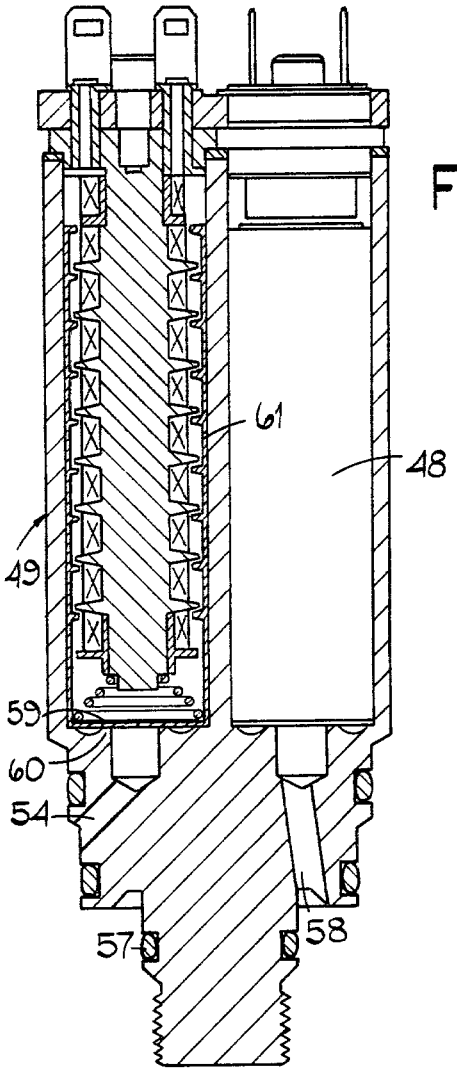
Figure 7:
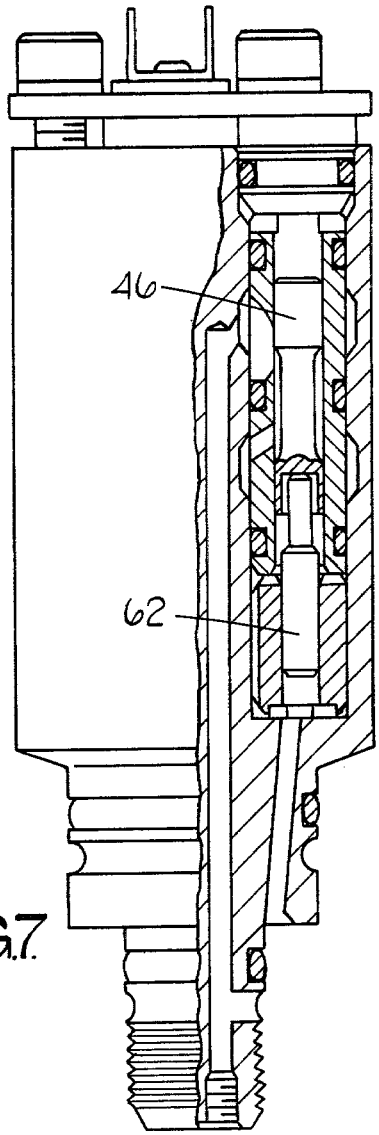
Figure 8:
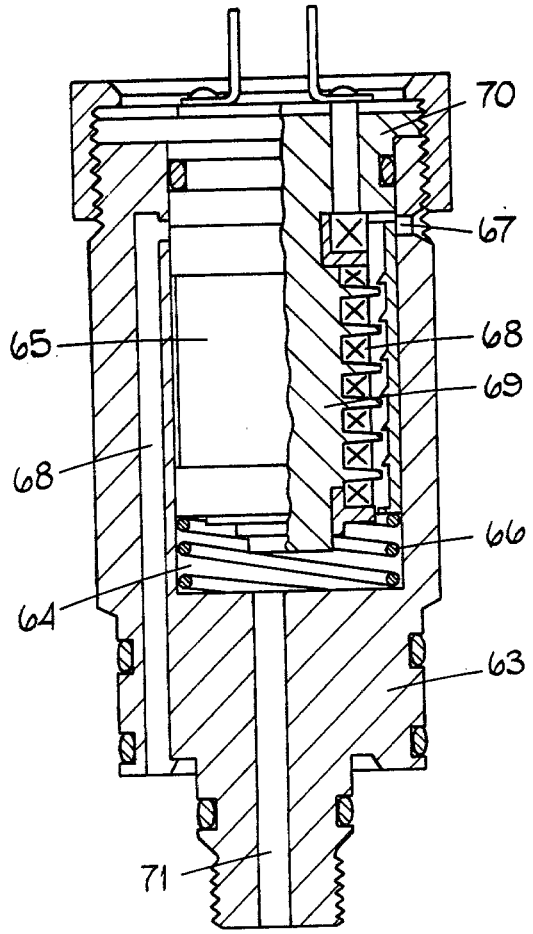
Figure 10:
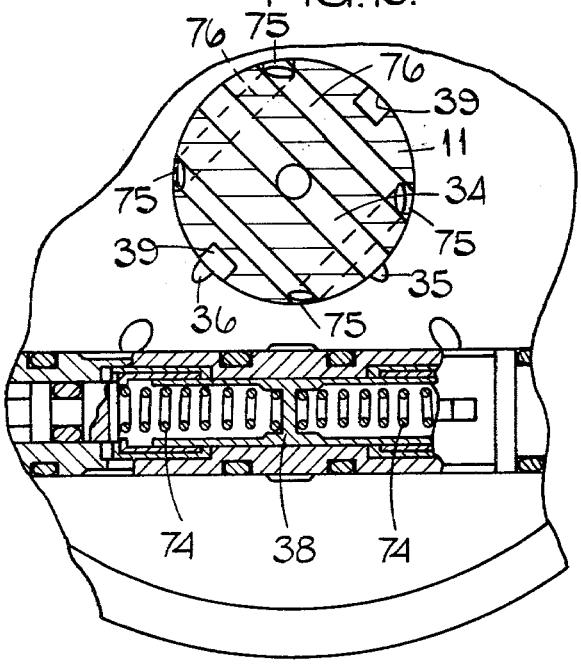
Figure 11:
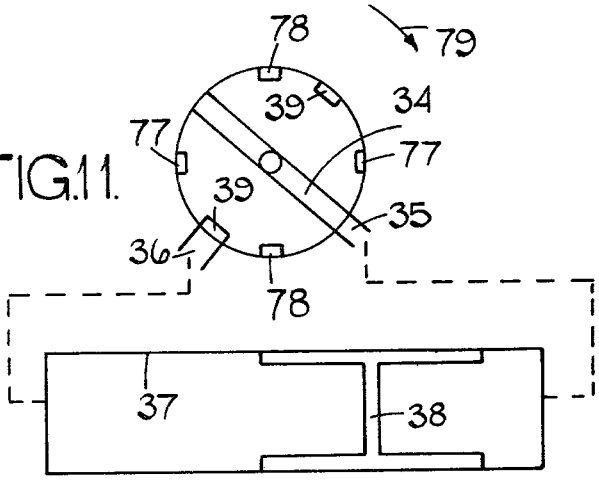
Figure 12:
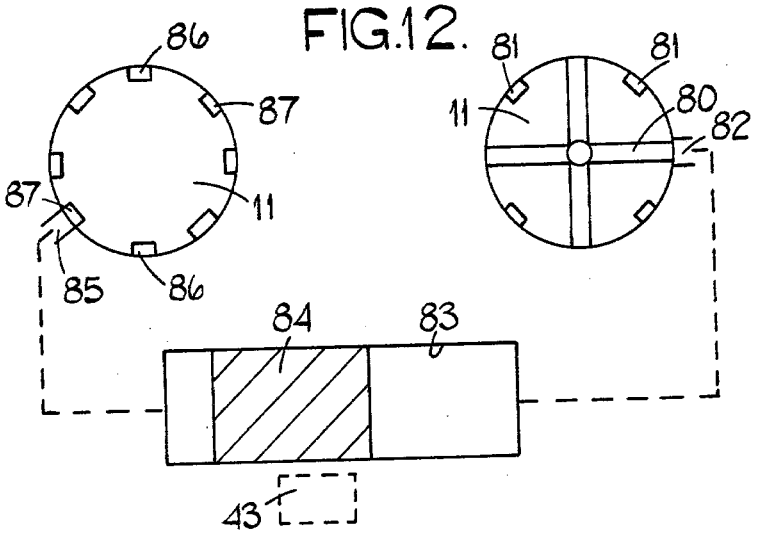
Figure 13:
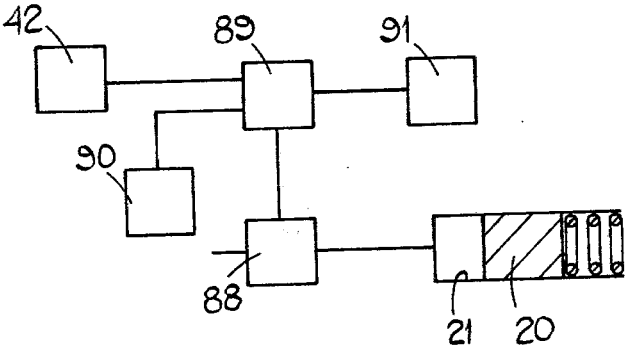

One example of an apparatus in accordance with the invention will now be described with reference to the accompanying drawings in which:

FIG. 1 is a sectional side elevation of the apparatus,

FIG. 2 is a diagrammatic view part of which is a section at right angles to the apparatus shown in FIG. 1, FIG. 3 is another section at right angles of the apparatus shown in FIG. 1, FIG. 4 is a diagram of part of the apparatus seen in FIGS. 1 and 2, FIGS. 5 and 6 show a practical embodiment of the part of the apparatus of FIG. 4, FIG. 7 shows a modification of the apparatus of FIG. 5, FIG. 8 shows an alternative construction to the part seen in FIG. 4, FIGS. 9, 10 and 11 show arrangements for centralising the shuttle seen in FIG. 2, FIG. 12 shows an alternative arrangement for determining the movement of the shuttle, FIG. 13 shows a diagram for achieving timing and control.

Referring to FIG. 1 of the drawings, the apparatus comprises a housing 10 in which is mounted a rotary cylindrical distributor member 11. The distributor member at one end is connected to a drive shaft 12 which in use, will be connected to a drive member of the associated engine, whereby the distributor member is driven in timed relationship with the associated engine.

Formed in the distributor member is a longitudinal passage 13 which communicates with the pump chamber of an injection pump generally indicated at 14. The injection pump comprises two pairs of plungers 15 disposed in transverse bores 16 formed in the distributor member, the axes of the bores being at right angles to each other. At their outer ends the plungers engage shoes which carry rollers 17 for engagement with the internal peripheral surface of an annular cam ring 18. The cam ring is angularly adjustable within the housing and for this purpose a laterally extending peg 19 is provided which is located in an aperture formed in a piston 20 slidable within a cylinder 21 formed in a part which is secured to the main housing 10. The piston 20 is biased towards one end of the cylinder by means of a coiled compression spring 22 and liquid under pressure can be admitted to the opposite end of the cylinder to urge the piston 20 against the action of the spring to produce advancement of the timing of delivery of fuel by the injection pump. A valve 23 is provided which will be discussed later, for controlling the amount of liquid supplied to the cylinder 21.

The cam ring 18 has two pairs of cam lobes 24 formed on its internal peripheral surface, the cam lobes of each pair being diametrically opposite each other and the pairs of cam lobes being disposed at right angles relative to each other so that the plungers will be moved inwardly at the same time.

The passage 13 communicates with a delivery passage 25 which extends to the periphery of the distributor member and which can register in turn with a plurality of outlets 26. Four outlets are provided in the apparatus shown and the arrangement is such that fuel is delivered to the outlets 26 in turn as the distributor member rotates. The outlets 26 in use are connected to the injection nozzles of an associated engine, the engine in the present example being a four cylinder engine.

Also provided is a feed pump 27 having an outlet 28 and an inlet 29. The rotary part 30 of the feed pump is mounted on the distributor member so as to rotate therewith and conveniently the feed pump is a vane type constant displacement pump. The output pressure of the feed pump is controlled by a spring loaded relief valve 31 which spills fuel from the outlet 28 of the pump to the inlet 29. Moreover, the inlet 29 of the feed pump is connected to a main inlet 33 which in use is connected to a source of fuel.

The longitudinal passage 13 communicates with a pair of feed passages 34 which extend to the periphery of the distributor member and which communicate in turn with a pair of ports 35, 36 which are formed in the housing and which communicate with the opposite ends of a cylinder 37 formed in the housing. Located within the cylinder 37 is a shuttle 38. Also provided on the periphery of the distributor member are a pair of longitudinally extending slots 39. The slots 39 are positioned so that they also can communicate with the ports 35, 36 and they are in constant communication with a circumferential groove 40 formed in the periphery of the distributor member. As shown in FIG. 2, the slots 39 are diametrically disposed and are at right angles relative to the feed passages 34.

The circumferential groove 40 communicates with the outlet 28 of the feed pump 27 by way of a fuel control device 41, the possible construction of which will be described later.

The operation of the apparatus this far described is as follows. As will be observed in FIG. 2, a feed passage 34 is in communication with the port 35 which in this situation constitutes a feed port. Moreover, one of the grooves 39 is in communication with the port 36. Fuel is therefore flowing by way of the control device 41 to the port 36 and into one end of the cylinder 37. The shuttle 38 is therefore being moved towards the right as seen in FIG. 2 and fuel is being supplied to the injection pump. This flow of fuel will continue until the feed passage 34 moves out of register with the feed port 35. Moreover, as the degree of registration of the feed port and feed passage decreases the rate of movement of the shuttle will also decrease and the shuttle will be brought to rest when the aforesaid communication ceases to exist. The shuttle therefore is brought to rest gradually. Moreover, it is important to note that the shuttle does not contact either the end of the cylinder 37 or any stop located in the cylinder. As the distributor member continues to rotate the delivery passage 25 moves into register with an outlet 26 and the rollers 17 engage the cam lobes 24 so as to impart inward movement to the plungers 15. Fuel is therefore displaced from the pumping chamber of the injection pump to the particular outlet and injection of fuel to the respective combustion spaces of the engine takes place. During continued rotation of the distributor member, the delivery passage moves out of register with an outlet and the rollers move clear of the cam lobes. The other feed passage 34 now moves into register with the port 36 and the slot 39 moves into register with the port 35. In this part of the operation therefore, the port 36 constitutes the feed port. Depending on the fuel control device 41 fuel is now supplied from the feed pump to the right hand end of the cylinder 37 and the shuttle 38 moves towards the left hand end of the cylinder displacing fuel into the injection pump. As before, the rate of movement of the shuttle 38 is reduced as the feed passage 34 moves out of register with the port 36 and the movement of the shuttle ceases when registration ceases. Once again it should be noted that the shuttle 38 does not contact the end of the cylinder 37. Thereafter, the cycle of operation is repeated and fuel is supplied to the outlets in turn and the shuttle 38 moves alternatively intermediate the ends of the cylinder.

The amount of fuel supplied to the injection pump and therefore supplied in the following injection stroke, is measured by the movement of the shuttle 38 and the amount of such movement is determined by the fuel control device 41. In the present apparatus, the displacement of the shuttle 38 is measured by means of a transducer and the signal obtained is passed to a signal processing means which controls the fuel control device 41. The signal processing means is indicated in FIG. 2 at 42 and the transducer which senses the displacement of the shuttle 38, at 43. The processing means 42 is electronic in nature and it receives an input signal at a terminal 44 representing the quantity of fuel which should be fed to the engine.

The fuel control device 41 can take several forms and the first of these is illustrated diagrammatically in FIG. 4 with the main constructional features being shown in FIGS. 5 and 6. An alternative arrangement is shown in FIG. 7. Referring to FIG. 4 there is provided a cylinder 45 in which is located a slidable piston 46. The piston 46 is provided intermediate its ends, with a circumferential groove which is in constant communication by way of a conduit 47 with the outlet 28 of the feed pump. One end of the cylinder can be placed in communication with the outlet 28 of the feed pump by way of a first valve 48 and the same end of the cylinder can be placed in communication with a drain by way of a second valve 49. The other end of the cylinder is in constant communication with a drain but it accommodates a coiled compression spring 50 whereby the piston 46 is biased towards said one end of the cylinder 45. The portion of the piston which is engaged by the spring serves to control the effective size of a port 51 which is formed in the wall of the cylinder 45 and which communication with the circumferential groove 40 in the periphery of the distributor member.

With the valves 48 and 49 closed an hydraulic lock is created in said one end of the cylinder 45 so that the piston 46 cannot move under the action of the spring 50. If the valve 48 is opened, fuel under pressure is supplied to said one end of the cylinder and the piston 46 is moved against the action of the spring 50. Such movement causes an increase in the effective size of the port 51 and therefore fuel can flow at an increased rate from the outlet of the feed pump to the circumferential groove 40. On the other hand, if the valve 48 is closed and the valve 49 opened, then the force exerted by the spring 50 displaces the piston 46 towards said one end of the cylinder and the effective size of the port 51 is reduced so that the rate of flow of fuel from the feed pump to the circumferential groove is reduced. The valves 48 and 49 are controlled by the signal processing means 42.

FIG. 5 shows the practical construction of the piston 46 and associated parts. The piston itself has hollow end portions to reduce its inertia so that it can act more quickly in response to pressure changes in said one end of the cylinder. Fuel under pressure from the outlet of the feed pump is supplied to the groove intermediate the ends of the piston through a plurality of ports 52 formed in the wall of the cylinder 45 and in this practical example the port 51 is disposed to be covered by the end of the piston at said one end of the cylinder. The port is references 51*a* in FIG. 5. and it communicates with a passage extending to a threaded end of the assembly whereby the assembly can be secured in the housing of the apparatus. Moreover, the other end of the cylinder 45 terminates at a port 53 in the side wall of the assembly and as shown in FIG. 6, the further port 54 breaks out on the periphery of the assembly between the same two sealing rings 55, 56. A further sealing ring 57 is provided adjacent the screw threaded portion of the assembly and extending from intermediate the sealing rings 56, 57 is a passage 58 through which fuel from the outlet 28 of the feed pump can flow. The valve 48 is shown in outline only but the valve 49 is shown in section and it comprises a valve member 59 which is spring loaded into contact with an annular seating to prevent flow of fuel through the port 54 to the drain. The valve member is integrally formed with the armature 61 of a fast acting electromagnetic device generally of the type described in the specification of British Pat. No. 1,504,873. The valve 48 is of similar construction. With the practical arrangement shown in FIGS. 5 and 6 it is the valve 49 which must be opened to allow an increase in the rate of fuel flow to the circumferential groove 40, whilst opening of the valve 48 reduces the rate of fuel flow. The position of the port 51*a* may however be moved so that the role of the valves 48 and 49 is the same as is shown in FIG. 4.

The example shown in FIG. 7 is a modification of the practical construction shown in FIG. 5. In this construction the spring 50 is omitted and the force necessary to move the piston 46 when the valve 49 is opened, is provided by a piston 62 which is of smaller diameter than the piston 46. The piston 62 engages the piston 46 and its end remote from the piston 46 is in constant communication with the outlet 28 of the feed pump. The outlet pressure of the feed pump acting on the piston 62 generates a force which urges the piston 46 upwardly as shown in FIG. 7. Thus when the valve 49 is opened the piston 46 will move upwardly. On the other hand when the valve 49 is closed and the valve 48 opened, the force exerted on the piston 46 by the output pressure of the feed pump will urge the piston 46 and the piston 62 downwardly.

It will be appreciated that with the fuel control devices described with reference to FIG. 5, 6, 4 and 7 the fuel flows to the circumferential groove 40 as soon as one of the grooves 39 registers with the port 35 or 36 and whilst the other of these ports is in register with a feed passage 34. The shuttle 38 is therefore moving during the whole of this time but nevertheless the movement of the shuttle 38 is brought to rest gradually as the ports, grooves and passage move out of register. When an indication is provided of the shuttle movement, the processing means 42 can effect any correction to the effective size of the ports 51 or 51*a* as may be required to ensure that the desired amount of fuel as represented by the signal applied to the terminal 44 is supplied to the injection pump preferably at the next filling stroke thereof.

A further example of the fuel control device 41 is seen in FIG. 8. In this case when the electro-magnetic device controls directly the size of an orifice interposed between the outlet 28 of the feed pump and the circumferential groove 40. As shown the device comprises a housing 63 in which is formed a chamber 64, the wall of which provides support for an armature 65 which is biased by a high rate spring 66 towards one end of the chamber. At its end remote from the spring there is formed in the wall of the chamber an annular groove 67 which is in communication with a passage 68 which in use is connected to the outlet 28 of the feed pump. The armature 65 is urged by the spring 66 to cover the groove 67 and it is urged in the opposite direction by magnetic flux which is created when windings 68 of a solenoid assembly 69 mounted on an end cap 70 is energised. The construction of the solenoid assembly and the armature are described in the specification of the aforementioned British Patent.

The peripheral wall of the armature 65 is relieved between its ends so as to minimise inertia and drag, so far as possible. It is anticipated however, that it will be necessary to impose a high-frequency a.c. ripple on the d.c. current which is supplied to the windings in order to cause the armature to "dither" this will reduce the effect of the static friction. The fuel flows through the groove 67 into the chamber 64 from whence it flows to the circumferential groove 40 by way of a passage 71.

As with the previous constructions the control device shown in FIG. 8 allows the flow of fuel into one end of the cylinder 37 all the time the aforesaid grooves, ports and passages are open to each other. In the same way however, the movement of the shuttle 38 is slowed as the degree of registration reduces and the shuttle is eventually stopped and the flow of fuel ceases when there is no longer any registration.

An alternative way of controlling the flow of fuel to whichever end of the cylinder 37 is in communication with a groove 39 is to utilize a valve which is opened at some time after registration of a groove 39 with one of the ports 35 and 36 has taken place. Fuel therefore flows at a fairly high rate into the appropriate end of the cylinder 37 but once again the movement of the shuttle 38 is slowed and eventually comes to rest as the groove, ports, and passage move out of register.

This form of control requires a valve which can be opened very quickly to permit the flow of fuel. Moreover, the processing means 42 must be supplied with a signal indicative of the position of the distributor member. For this purpose a transducer may be provided to sense the angular position of the distributor member. If the transducer 43 senses that less than the required amount of fuel has been supplied to the injection pump then the valve will be opened earlier while the various flow passages are in communication with each other.

From FIG. 2 it will be observed that the shuttle 38 is freely located in the cylinder 37. It is found in use that the shuttle will tend to drift towards one end of the cylinder 37. As has been explained it is important to prevent the shuttle 38 engaging the end of the cylinder from which fuel is being supplied to the injection pump. If such contact is allowed then cavitation may occur and this as previously explained will upset the precise control of the supply of fuel to the injection pump which is required. Moreover, even assuming that cavitation did not take place, the precise delivery of fuel to the injection pump would not take place and the injection pump during alternate filling strokes would receive more fuel than during the remaining filling strokes. It is therefore necessary to centralize the shuttle to avoid it contacting the end of the cylinder. It is not necessary that the shuttle should be precisely centred. All that is required is that it should not contact an end of the cylinder.

One way in which centralisation may be achieved is to sense when during operation, the shuttle reaches a position which is near to the end of the cylinder. This sensing can be achieved electrically using the transducer 43. When the fact that the shuttle is near the end of the cylinder is detected, the fuel control device 41 can be operated to ensure that in the next filling period the shuttle is moved further towards the other end of the cylinder than is necessary bearing in mind the amount of fuel which is required to be supplied to the injection pump. This means that in the next filling stroke the injection pump will receive more fuel than is appropriate to the signal applied to the terminal 44. Following the correction of the position of the shuttle the fuel control device is adjusted to provide the required volume of fuel.

Figure 9:
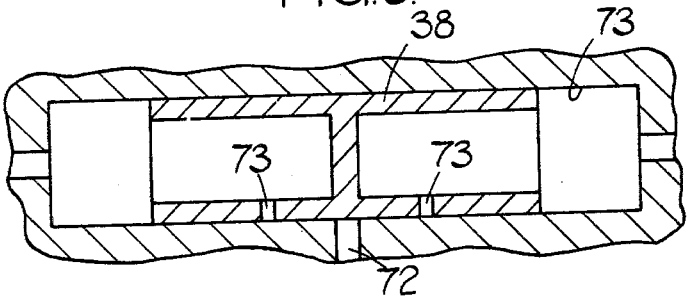

A further method of achieving shuttle centralisation will be described with reference to FIG. 9. As seen in FIG. 9 the end portions of the shuttle 38 are hollowed to lighten and shuttle to enable it to move more quickly in the cylinder 37. The ends of the cylinder are connected as shown in FIG. 2, to the ports 35 and 36. Moreover, intermediate the ends of the cylinder there is provided in the wall of the cylinder, a port 72 which communicates with a drain and formed in the walls of the end portions of the shuttle 38 there is provided a pair of ports 73. In normal use, the maximum quantity of fuel which will be supplied to the injection pump, will not move the shuttle by an amount sufficient to place a port 73 in communication with the port 72 assuming that the range of movement of the shuttle is centrally disposed between the ends of the cylinder. If however, after a period of use, the shuttle has migrated towards one end of the cylinder 37 then while fuel is being supplied from that end of the cylinder to the injection pump, the port 73 at the opposite end of the piston will move into register with the port 72, and thereafter the fuel under pressure which is being supplied from the outlet of the feed pump by way of the fuel control device 41, will pass through the registering ports 73 and 72 and the movement of the shuttle will be halted. As a result the displacement of the shuttle will be less than required and this will be detected by means of the transducer 43. The signal processing means 42 will then adjust the fuel control device 41 so that the shuttle is moved further towards the other end of the cylinder when fuel is supplied to said one end of the cylinder.

A further way of centralizing the shuttle within its cylinder is shown in FIG. 10 and utilising this method the centralization of the shuttle is achieved between the filling strokes of the injection pump. As will be seen from FIG. 10 the shuttle 38 has its end portions hollowed as in the example of FIG. 9 and a pair of coiled compression springs are located within the hollowed portions of the shuttle respectively and bear against the adjacent ends of the cylinder in which the shuttle is located. Moreover, it is arranged that the ports 35 and 36 are brought into communication with each other intermediate the filling periods of the injection pump. This is achieved by utilizing four equiangularly spaced slots 75 formed on the periphery of the distributor member 11, the slots 75 being in communication with each other by way of drillings 76 formed in the distributor member. The slots 75 are alternately arranged with the slots 39 and with the outer ends of the feed passages 34. As the distributor member rotates therefore after a filling stroke of the injection pump, a pair of slots 75 will move into register with the ports 35 and 36 and when this happens the shuttle centralizes itself under the action of the compressed spring 74. The shuttle therefore always starts moving during filling of the injection pump, from a substantially central position in the cylinder. It will be clear that in this arrangement the cylinder will have to be longer for a given diameter to permit the desired movement of the shuttle. As shown the springs 74 are both in engagement with the shuttle when the latter is in its central position. For correct centering of the shuttle the springs must be identical however, even if their operating characteristics are slightly different, the shuttle will assume a substantially central position.

With the arrangement shown in FIG. 10 no adjustment of the fuel control device 41 is required to achieve correction.

The arrangement shown in FIG. 10 can be modified by arranging that the springs do not, when the shuttle is in the central position, contact the shuttle. The springs may be free springs or they may be preloaded. Moreover, the grooves 75 are not provided. With this arrangement assuming that the shuttle tends to migrate towards one end of the cylinder then when during filling of the injection pump the shuttle moves towards this end of the cylinder it will as migration continues, contacts one of the springs and its movement will be hindered and the extent of movement reduced below that which is required to displace the desired amount of fuel to the injection pump. The reduction in shuttle displacement will be detected by the transducer and the signal processing means will adjust the fuel control device so that at the next filling stroke, the movement of the shuttle will be increased. However, the initial portion of this movement will be assisted by the action of the compressed spring at the one end of the cylinder and this alone will ensure that the shuttle moves an increased amount. However, the fact that the control device 41 is set to allow more fuel into the cylinder means that the shuttle will travel an additional amount thereby moving the shuttle further towards the other end of the cylinder. The increased movement of the shuttle will again be detected by the transducer and the control device adjusted to reduce the stroke of the shuttle. The practical effect therefore is to shift the piston in the opposite direction to that in which it was migrating. This arrangement does result in an additional quantity of fuel being supplied to the injection pump whilst correction is taking place.

A further way of overcoming the problem of shuttle drift is shown in FIG. 11. The various passages, ports and grooves together with the cylinder and shuttle are provided with the same reference numerals as FIG. 2. It will be noted however, that four further grooves are provided disposed in the same way as the grooves 75 in the arrangement of FIG. 10. The diametrically opposite grooves are connected together and the pairs of grooves are provided with the reference numbers 77 and 78. The direction of rotation of the distributor is indicated by the arrow 79. With the various parts in the position shown, fuel is being supplied to the injection pump from the right hand end of the cylinder 37 but as the distributor member rotates the movement of the shuttle 38 will be halted before it reaches the end of the cylinder. Continued rotation of the distributor member brings one of the grooves 77 into register with the port 35 and one of the grooves 78 into register with the port 36. The grooves 77 are connected to drain while the grooves 78 are connected to the outlet 28 of the feed pump. The effect of this communication is to drive the shuttle 38 towards the right into engagement with the end of its cylinder. Such engagement occurs whilst the injection pump is isolated from the ends of the cylinder so that any cavities which may form will not influence the quantity of fuel which is supplied by the injection pump. The shuttle 38 is therefore firmly held at the right hand end of the cylinder and during continued rotation of the distributor member the left hand end of the cylinder is connected to one of the grooves 39 as is the case with the example shown in FIG. 2. The shuttle will therefore start to move towards the left and such movement starts from the end of the cylinder. The displacement of the shuttle is measured by means of the transducer as is described. When the shuttle is brought to rest again as described, the same groove 77 is moved into register with the port 36 and the other groove 78 is brought into register with the port 35. As a result the shuttle 38 is driven to the left hand of the cylinder and the cycle of operation is repeated.

It will be seen that with the arrangement shown in FIG. 11, the shuttle always starts from one end of the cylinder but it does not engage the end of the cylinder while fuel is being supplied to the injection pump.

In each of the examples described the shuttle 38 can be regarded as being a double acting shuttle since it is driven towards opposite ends of the cylinder in turn during the successive filling strokes of the injection pump. It is possible however, to modify the arrangement shown in FIG. 11 so that the shuttle can be regarded as being single acting. With this arrangement instead of continuing the movement of the shuttle after filling the injection pump, the shuttle is returned to the end of the cylinder from which it is started. As example of this arrangement is shown in FIG. 12.

Referring to FIG. 12, the feed passages are indicated at 80 and it will be noted that they are four in number the apparatus being intended to supply fuel to a four cylinder engine. Equi-angularly spaced about the distributor member are four grooves 81 which are in constant communication with the output of the feed pump. The grooves 81 and feed passages 80 register in turn with a feed port 82 which communicates with one end of a cylinder 83 containing a shuttle 84. The opposite end of the cylinder 83 is connected to a further port 85 which opens into the periphery of the distributor member at an axially spaced position relative to the port 82. The port 85 is displaced at 45° from the port 82. Moreover, formed on the periphery of the distributor member at this point are two series of longitudinal grooves 86, 87. These grooves are alternately positioned about the distributor member for register with the port 85. The grooves 87 are in communication with each other and with the fuel control device 41 while the grooves 86 are in constant communication with a drain. In the position shown, the port 82 is in register with a feed passage 80 and the port 85 in register with a groove 87. Fuel will therefore flow to said other end of the cylinder 83 from the fuel control device 41 and the shuttle 84 will be moved towards the right as seen in the drawing thereby displacing fuel to the injection pump. As in the previous examples, the shuttle 84 is not allowed to engage the end of the cylinder and it is brought to rest gradually as the feed passage 80 moves out of register with the feed port 82. The extent of movement of the shuttle towards said one end of the cylinder is measured as in the previous example, by a transducer 43. As the distributor member rotates, a groove 81 is brought into register with the port 82 and a groove 86 in register with the port 85. Fuel from the outlet of the feed pump now flows to said one end of the cylinder and the shuttle 84 is returned to said other end of the cylinder. It remains in this position until it is moved towards the right-hand end of the cylinder when a groove 87 registers with the port 85 and a feed passage 80 registers with the port 82. This arrangement has the advantage over the arrangement shown in FIG. 11 that the movement of the shuttle is considerably less and therefore there is less wastage of fuel to the drain. A slight disadvantage is the fact that the distributor member must be provided with additional grooves.

The timing of the delivery of fuel to the engine is an important factor in minimizing the emission of smoke and achieving the maximum performance from the engine. As previously mentioned, the annular cam ring 18 is angularly movable by means of a piston 20 which is housed in a cylinder 21. Fuel from the outlet of the feed pump is admitted to the cylinder 21 by means of an electrically operated valve 88. A leakage path is provided between the piston and the wall of the cylinder so that if the valve is maintained in the closed position the piston 20 will gradually move under the action of its spring. The supply of electrical power to the valve 88 is controlled by a timing control circuit 89 which from at least two input signals, determines the desired timing of injection. A transducer 91 is provided which senses the actual position of the cam ring, the transducer 91 being indicated in FIG. 3. The position of the cam ring can therefore be arranged so that the correct timing of delivery is achieved. The signals supplied to the circuit 89 include a fuel quantity signal which is obtained from the signal processing means 42. In addition, a speed signal is supplied which is obtained from a transducer 90 which can be responsive to the speed of rotation of the distributor member. A more accurate control of the timing can be achieved if one or all of the injection nozzles incorporates a transducer to provide an indication of when the fuel is actually delivered to the engine. In addition to a signal from such a transducer, a further transducer is required which provides an indication of the position of the crankshaft of the engine or some other part of the engine.

The transducer 91 which senses the position of the cam ring may be replaced by a transducer mounted on the end closure of the cylinder 21. In this position the transducer senses the position of the piston 20 and hence the cam ring.

The apparatus described enables the quantity of fuel supplied to the engine to be carefully regulated and it is able to do this by the fact that an accurate measure of the amount of fuel supplied at each injection stroke of the injection pump is provided.

We claim:

1. A liquid fuel injection pumping apparatus for supplying fuel to an internal combustion engine and comprising a housing, a rotary distributor member mounted within the housing and which in use is driven in timed relationship with the associated engine, an injection pump also driven in use, in timed relationship with the engine, the injection pump including a pump chamber, the apparatus further including a delivery passage formed in the distributor member and communicating with the pump chamber, an outlet port formed in the housing and with which the delivery passage registers during an injection stroke of the injection pump, a feed port formed in the housing and a feed passage in the distributor member communicating with the pump chamber, said feed port and feed passage being brought into registration in the interval between injection strokes of the injection pump, a feed pump for supplying liquid fuel at a low pressure, a shuttle movable in a cylinder, said shuttle and said cylinder being sized to accommodate a predetermined volume of fuel on either end of said shuttle, said predetermined volume of fuel being greater than the volume of fuel required during operation of said injection pump, control means for controlling the flow of fuel to one end of said cylinder while the other end of said cylinder is in communication with said feed port, fuel being supplied from each end of the cylinder in turn to the injection pump, the rate of movement of said shuttle towards said other end of the cylinder being reduced as the feed passage moves out of register with the feed port and the movement of the shuttle ceasing as the feed port and feed passage move out of register and prior to said shuttle reaching an end of said cylinder, measuring means for measuring the displacement of the shuttle which takes place while fuel is flowing from said other end of the cylinder and signal processing means responsive to the signal produced by the said measuring means for adjusting said control means in the event that the quantity of fuel supplied to the injection pump differs from the desired quantity of fuel.

2. An apparatus according to claim 1 including means for sensing when the shuttle attains a position near to an end of the cylinder said control means then being actuated to increase the flow of fuel to said end of the cylinder during movement of the shuttle towards the other end of the cylinder thereby to centralize the shuttle within the cylinder.

3. An apparatus according to claim 2 in which the means for sensing is embodied in said measuring means and said signal processing means.

4. An apparatus according to claim 1 including a drain port formed in the wall of the cylinder at a position substantially half way between the ends of the cylinder, said port being uncovered by the shuttle to one or the other end of the cylinder in the event that the shuttle has migrated towards an end of the cylinder, the arrangement being that when said port is uncovered to one end of the cylinder further movement of the shuttle away from said one of the cylinder will cease and said measuring means and said signal processing means will adjust the control means so as to cause the shuttle to move further towards said one end of the cylinder thereby to centralize the shuttle within the cylinder.

5. An apparatus according to claim 1 including a pair of springs acting in opposite directions on the shuttle and means for placing the opposite ends of the cylinder in communication with each in the intervals between the periods of fuel supply to the injection pump.

6. An apparatus according to claim 5 in which said springs are coiled compression springs and are located within recesses formed in the ends of the shuttle, said springs engaging the end walls of the cylinder respectively.

7. An apparatus according to claim 5 in which the means for placing the ends of the cylinder in communication with each other comprises connected ports on the periphery of the distributor member for registration with the feed port and a port communicating with the one end of the cylinder.

8. An apparatus as claimed in claim 1 including resilient means disposed at the opposite ends of the cylinder respectively, one or the other of said resilient means acting in the event that migration of the shuttle has taken place, to hinder the movement of the shuttle during the supply of fuel to the injection pump, the reduced shuttle movement being sensed by the signal processing means which causes an increased rate of fuel supply to the appropriate end of the cylinder to centralise the shuttle.

9. A liquid fuel injection pumping apparatus for supplying fuel to an internal combustion engine and comprising a housing, a rotary distributor member mounted within the housing and which in use is driven in timed relationship with the associated engine, an injection pump also driven in use, in timed relationship with the engine, the injection pump including a pump chamber, the apparatus further including a delivery passage formed in the distributor member and communicating with the pump chamber, an outlet port formed in the housing and with which the delivery passage registers during an injection stroke of the injection pump, a feed port formed in the housing and a plurality of feed passages in the distributor member communicating with the pump chamber and registering in turn with said feed port, said feed port and a feed passage being brought into registration in the interval between injection strokes of the injection pump, a feed pump for supplying liquid fuel at a low pressure, a shuttle movable in a cylinder, a plurality of supply grooves on the distributor member for register in turn with a supply port communicating with the one end of the cylinder containing the shuttle, control means for controlling the flow of fuel to said one end of said cylinder through said supply grooves to the supply port whilst the other end of said cylinder is in communication with said feed port, the rate of movement of said shuttle towards said other end of the cylinder being reduced as the feed passage moves out of register with the feed port and the movement of the shuttle ceasing as the feed port and feed passage move out of register, measuring means for measuring the displacement of the shuttle which takes place while fuel is flowing from said other end of the cylinder, signal processing means responsive to the signal produced by the said measuring means for adjusting said control means in the event that the quantity of fuel supplied to the injection pump differs from the desired quantity of fuel, and means for returning the shuttle to the one end of the cylinder after the feed passage has moved out of register with the feed port comprising a first set of grooves interspaced with said feed passages and a second set of grooves interspaced with said supply grooves, said first and second sets of grooves being connected to a source of fuel under pressure and a drain respectively, whereby after fuel has been supplied to the injection pump, the shuttle will be returned to said one end of the cylinder.

10. A liquid fuel injection pumping apparatus for supplying fuel to an internal combustion engine and comprising: a housing, a rotary distributor member mounted within the housing and which in use is driven in timed relationship with the associated engine, an injection pump also driven in use, in timed relationship with the engine, the injection pump including a pump chamber, the apparatus further including a delivery passage formed in the distributor member and communicating with the pump chamber, an outlet port formed in the housing and with which the delivery passage registers during an injection stroke of the injection pump, a feed port formed in the housing and a feed passage in the distributor member communicating with the pump chamber, said feed port and feed passage being brought into registration in the interval between injection strokes of the injection pump, a feed pump for supplying liquid fuel at a low pressure, a shuttle movable in a cylinder, said shuttle and said cylinder being sized to accommodate a predetermined volume of fuel on either end of said shuttle, said predetermined volume of fuel being greater than the volume of fuel required during operation of said injection pump, control means for controlling the flow of fuel to one end of said cylinder while the other end of said cylinder is in communication with said feed port, the rate of movement of said shuttle towards said one end of the cylinder being reduced as the feed passage moves out of register with the feed port and the movement of the shuttle ceasing as the feed port and feed passage move out of register and prior to said shuttle reaching an end of said cylinder or any abutment within said cylinder, measuring means for measuring the displacement of the shuttle which takes place while fuel is flowing from said one end of the cylinder and signal processing means responsive to the signal produced by the said measuring means for adjusting said control means in the event that the quantity of fuel supplied to the injection pump differs from the desired quantity of fuel.

11. An apparatus according to claim 1 including means for returning the shuttle to the one end of the cylinder after the feed passage has moved out of register with the feed port.

12. An apparatus according to claim 1 in which said control means includes an adjustable throttle.

13. An apparatus according to claim 12 in which the size of the throttle is determined directly by the magnitude of an electric current supplied to an electromagnetic device.

14. An apparatus according to claim 13 in which the electromagnetic device comprises an armature movable within a housing, the housing defining a port which is obturated by a part of the armature and forming the throttle, a spring biasing the armature in a direction to reduce the size of the port and a solenoid which when energised with direct current creates a magnetic field acting to move the armature against the action of the spring.

15. An apparatus according to claim 14 including means for supplying an alternating current to said solenoid to cause vibration of the armature.

16. An apparatus according to claim 12 in which the throttle includes a piston slidable within a cylinder, means biasing the piston towards one end of said cylinder a port in the wall of said cylinder and a groove on the piston for variable registration with said port, said port and groove forming part of the flow path of fuel fuel and electromagnetic valve means for controlling the application of fluid pressure to said piston.

17. An apparatus according to claim 16 in which said electromagnetic valve means comprises a pair of electromagnetic valves one operable to cause an increase in the fluid pressure applied to said piston and the other operable to cause a decrease in the pressure applied to said piston.

18. An apparatus according to claim 1 in which said control means includes an electromagnetic valve operable in timed relationship with the distributor member to allow substantially unrestricted flow of fuel from the feed pump to said one end of the cylinder, the instant said valve is opened being determined by said signal processing means whereby the amount of fuel supplied to the injection pump can be varied.

* * * * *